US008419241B2

(12) United States Patent
Jen et al.

(10) Patent No.: US 8,419,241 B2
(45) Date of Patent: Apr. 16, 2013

(54) ADJUSTABLE LAMP STRUCTURE

(75) Inventors: Hui-Feng Jen, New Taipei (TW); Che-Hsin Liao, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 1 day.

(21) Appl. No.: 13/310,803

(22) Filed: Dec. 5, 2011

(65) Prior Publication Data

US 2012/0212969 A1 Aug. 23, 2012

(30) Foreign Application Priority Data

Feb. 23, 2011 (TW) ..... 100106044 A

(51) Int. Cl.
*F21V 33/00* (2006.01)

(52) U.S. Cl.
USPC ..... 362/418; 362/640; 362/647; 362/254; 362/458

(58) Field of Classification Search ..... 362/640, 362/647, 254, 255, 256, 457, 458, 418, 429
See application file for complete search history.

(56) References Cited

U.S. PATENT DOCUMENTS

| | | | | |
|---|---|---|---|---|
| 1,189,044 | A * | 6/1916 | Boden | 248/333 |
| 1,309,051 | A * | 7/1919 | Willman | 362/429 |
| 2,118,785 | A * | 5/1938 | Birdseye et al. | 439/6 |
| 6,764,204 | B1 * | 7/2004 | Peters | 362/429 |
| 2010/0264821 | A1 * | 10/2010 | Lutz et al. | 315/32 |

* cited by examiner

*Primary Examiner* — Laura Tso
(74) *Attorney, Agent, or Firm* — Jianq Chyun IP Office

(57) ABSTRACT

An adjustable lamp structure includes a first and a second adapters, an adapter ring, a limiting unit, a heat sink, and a lampshade. The second adapter is configured in the first adapter, and the adapter ring is configured at the second adapter. The adapter ring has a surface facing the second adapter and pillars configured on the surface. The second adapter is engaged with the pillars. The limiting unit is located in the second adapter and fixed at ends of the pillars to limit a moving distance of the second adapter on the pillars. The heat sink is engaged with the adapter ring and located at one side of the adapter ring. The lampshade is configured at one side of the heat sink. The entire length of the lamp structure can be changed by adjusting relative positions of the second adapter and the pillars.

11 Claims, 4 Drawing Sheets

ADJUSTABLE LAMP STRUCTURE

CROSS-REFERENCE TO RELATED APPLICATION

This application claims the priority benefit of Taiwan application serial no. 100106044, filed on Feb. 23, 2011. The entirety of the above-mentioned patent application is hereby incorporated by reference herein and made a part of this specification.

BACKGROUND OF THE INVENTION

1. Field of the Invention

The invention relates to a lamp structure. More particularly, the invention relates to a lamp structure of which the entire length is adjustable.

2. Description of Related Art

The illumination lamps have been transformed into energy-saving light bulbs from light bulbs and fluorescent lamps ever since lamps were invented, and different applications of the illumination lamps lead to different illumination effects.

At present, most lamps individually comply with one single standard. Namely, each of the lamps is required to have one single specification no matter whether the lamps are light tubes or bulbs, no matter what lamp base of each lamp is, and no matter what the lengths, the brightness, and the shapes of the lamps are. Thus, materials complying with individual standards are required when different orders are received from customers, and the manufacturing costs of suppliers cannot be effectively lowered down.

As a result, many researches are conducted by manufacturers in this field for the need of commonly using the lamps with different specifications.

SUMMARY OF THE INVENTION

The invention is directed to an adjustable lamp structure that can catch up with requirements for customization.

In an embodiment of the invention, an adjustable lamp structure suitable for being configured on a lamp base is provided. The adjustable lamp structure includes a first adapter, a second adapter, an adapter ring, at least one limiting unit, a heat sink, and a lampshade. The first adapter is suitable for being configured on the lamp base, and the second adapter is configured in the first adapter. The adapter ring is configured at one side of the second adapter away from the first adapter. Besides, the adapter ring has a surface and a plurality of pillars, and the surface faces the second adapter. The pillars are configured on the surface, and the second adapter is engaged with the pillars. The limiting unit is located in the second adapter and fixed at ends of the pillars away from the surface, so as to limit a moving distance of the second adapter on the pillars. The heat sink is engaged with the adapter ring and located at one side of the adapter ring away from the second adapter. The lampshade is configured at one side of the heat sink relatively away from the first adapter. The entire length of the lamp structure can be changed by adjusting relative positions of the second adapter and the pillars.

According to an embodiment of the invention, the first adapter has an external thread.

According to an embodiment of the invention, a material of the adapter ring is metal, and the pillars are protrusions extending from the surface.

According to an embodiment of the invention, the at least one limiting unit refers to a plurality of screws, and a diameter of a head of each of the screws is greater than an outer diameter of each of the pillars.

According to an embodiment of the invention, the at least one limiting unit includes a cover and a plurality of screws. The cover is configured at the ends of the pillars away from the surface, and the screws pass through the cover and are correspondingly locked to the pillars.

According to an embodiment of the invention, the second adapter has a plurality of first positioning structures, and the adapter ring has a plurality of second positioning structures. The first positioning structures and the second positioning structures are correspondingly buckled, so as to position the second adapter relative to the pillars. When the second positioning structures are protrusions, the first positioning structures are grooves. Alternatively, when the second positioning structures are grooves, the first positioning structures are protrusions. The adapter ring has a first portion and a second portion. The first portion surrounds the second portion, and the surface and the pillars are located on the second portion. The second adapter has a third portion and a fourth portion. The third portion is lodged in the first adapter, and the fourth portion is lodged in the second portion of the adapter ring. The first positioning structures are configured at the third portion, and the second positioning structures are configured at one side wall of the second portion. Alternatively, the second positioning structures are configured at the pillars, and the second adapter further has a fifth portion connected between the third portion and the fourth portion. The first positioning structures are configured at a side surface of the fifth portion in contact with the pillars.

Based on the above, in the adjustable lamp structure described in the embodiments of the invention, the pillars of the adapter ring allow the second adapter to move on the pillars. Thereby, the entire length of the lamp structure can be adjusted based on actual requirements, so as to meet the requirements for customization.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
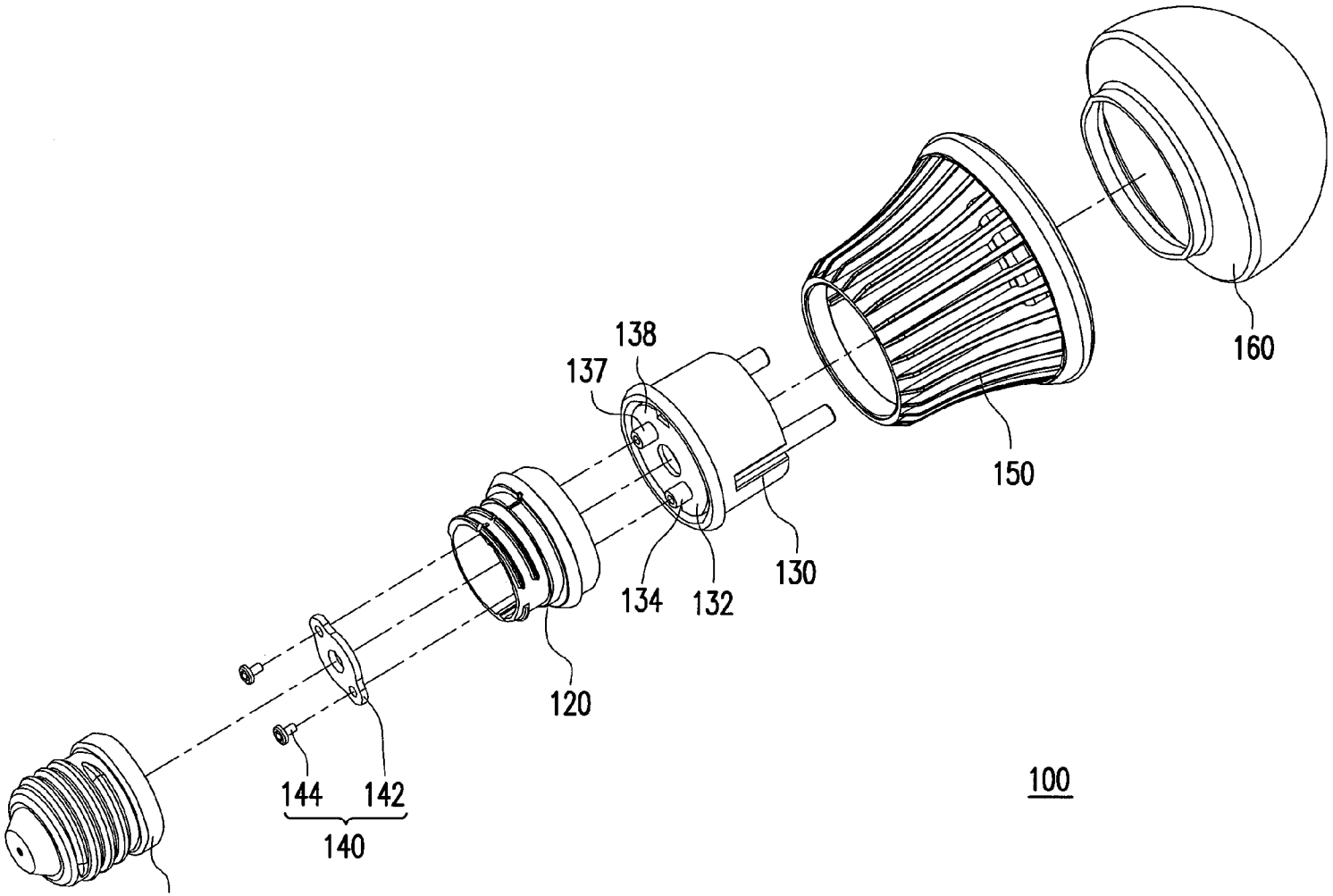
FIG. 1 is a schematic exploded view illustrating a lamp structure according to an embodiment of the invention.

FIG. 1 is a schematic exploded view illustrating a lamp structure according to an embodiment of the invention. FIG.

Figure 2A:
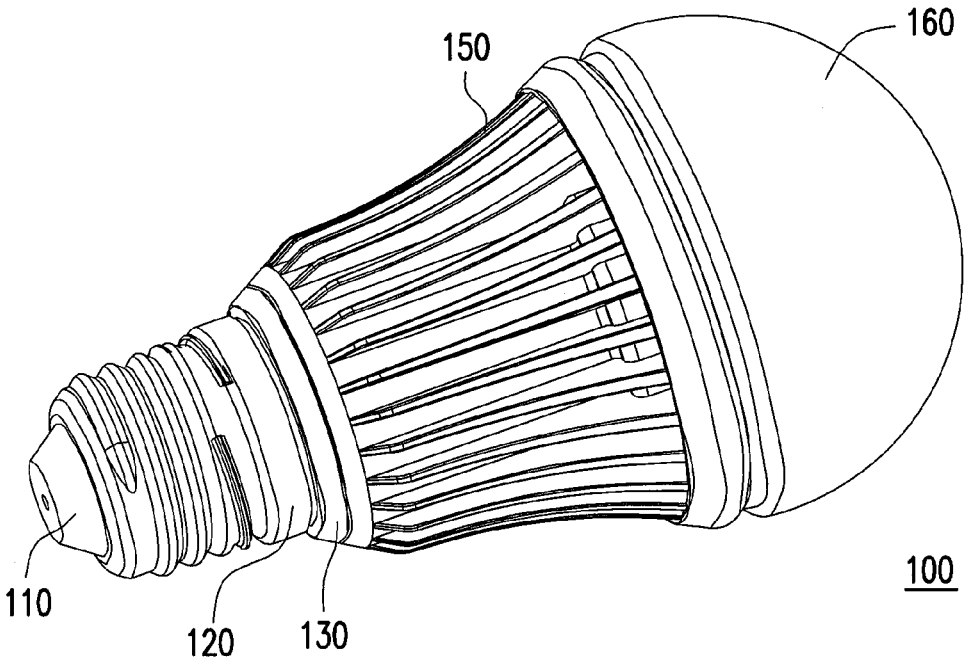
FIG. 2A and FIG. 2B schematically illustrate an assembly of the lamp structure depicted in FIG. 1 and the lamp structure with the adjusted length, respectively.
Figure 2B:
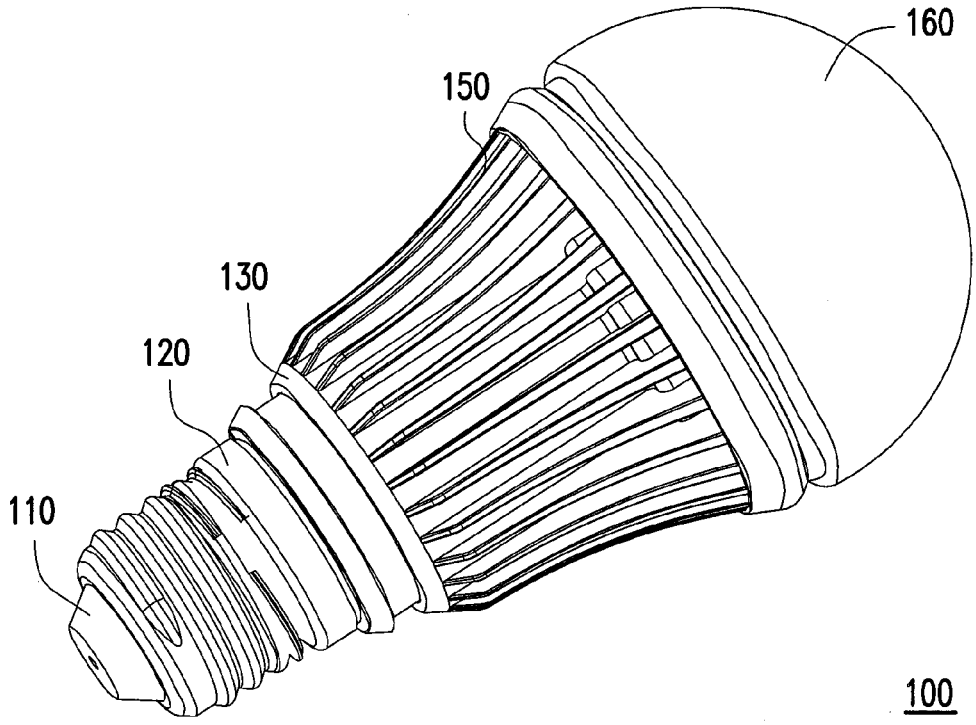

2A and FIG. 2B schematically illustrate an assembly of the lamp structure depicted in FIG. 1 and the lamp structure with the adjusted length, respectively. With reference to FIG. 1, FIG. 2A, and FIG. 2B, the adjustable lamp structure 100 in this embodiment is suitable for being configured on a lamp base. The adjustable lamp structure 100 includes a first adapter 110, a second adapter 120, an adapter ring 130, at least one limiting unit 140, a heat sink 150, and a lampshade 160. The first adapter 110 is suitable for being configured on the lamp base, and the second adapter 120 is configured in the first adapter 110. The adapter ring 130 is configured at one side of the second adapter 120 away from the first adapter 110. Besides, the adapter ring 130 has a surface 132 and a plurality of pillars 134, and the surface 132 faces the second adapter 120. The pillars 134 are configured on the surface 132, and the second adapter 120 is engaged with the pillars 134. The limiting unit 140 is located in the second adapter 120 and fixed at ends of the pillars 134 away from the surface 132, so as to limit a moving distance of the second adapter 120 on the pillars 134. The heat sink 150 is engaged with the adapter ring 130 and located at one side of the adapter ring 130 away from the second adapter 120. The lampshade 160 is configured at one side of the heat sink 150 away from the first adapter 110. The entire length of the lamp structure 100 can be changed by adjusting relative positions of the second adapter 120 and the pillars 134. As such, the lamp structure 100 can be applied to meet the requirement for customization.

Figure 3A:
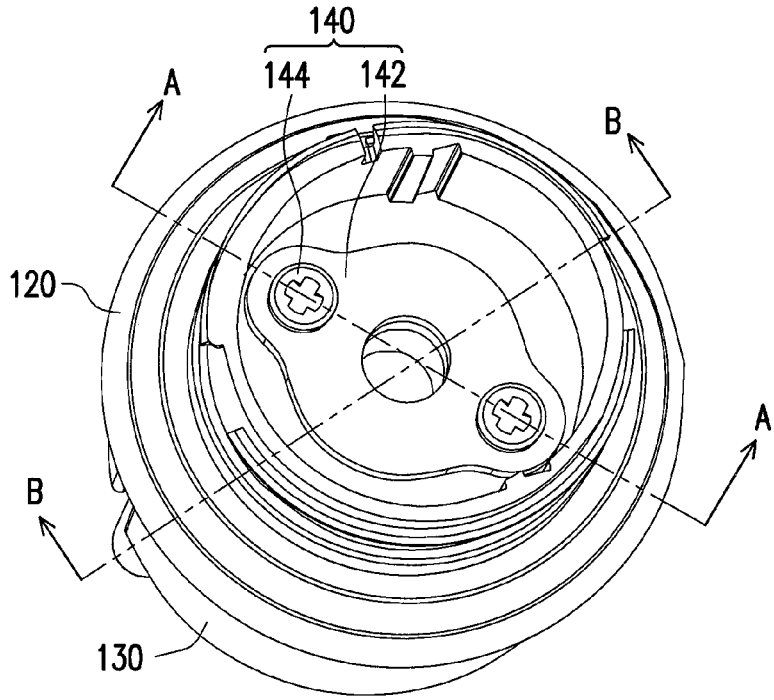
FIG. 3A is a schematic three-dimensional view illustrating the assembly of a limiting unit, a second adapter, and an adapter ring.
Figure 3B:
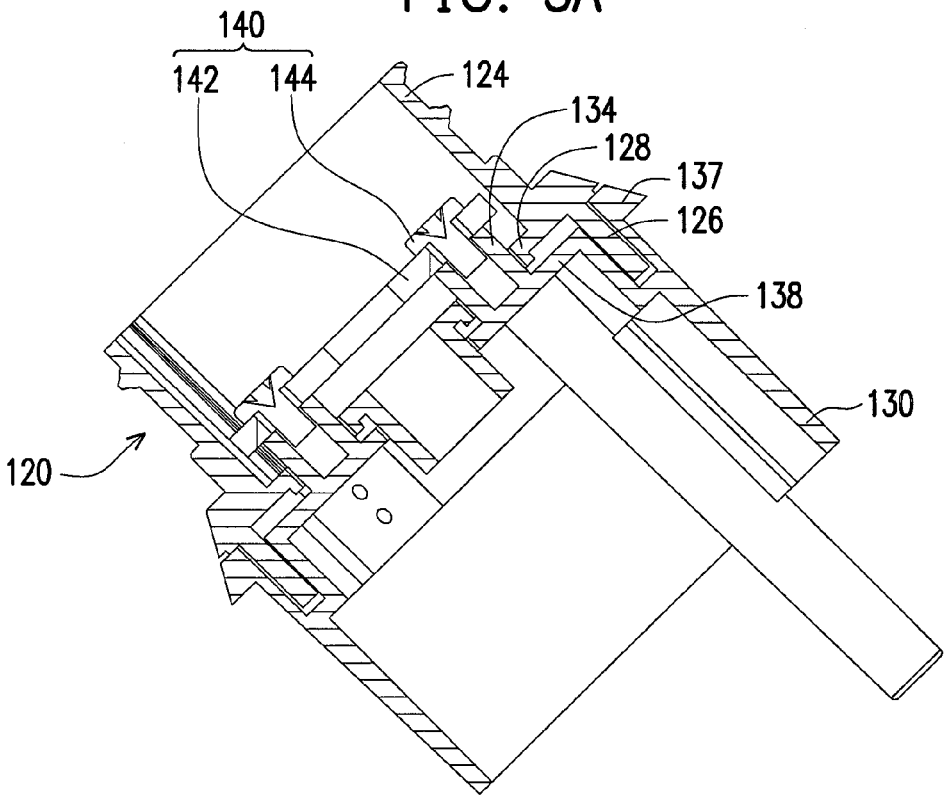
FIG. 3B is a schematic cross-sectional view taken along a sectional line A-A depicted in FIG. 3A.

The adjustable lamp structure 100 of this embodiment is a light bulb, and the first adapter 110 of the lamp structure 100 has an external thread. The adapter ring 130 can be made of metal or plastic. If the adapter ring 130 is made of metal, an insulation pad is required for electrical insulation. Besides, the pillars 134 are protrusions extending from the surface 132 of the adapter ring 130. FIG. 3A is a schematic three-dimensional view illustrating the assembly of the limiting unit, the second adapter, and the adapter ring. FIG. 3B is a schematic cross-sectional view taken along a sectional line A-A depicted in FIG. 3A. With reference to FIG. 1, FIG. 3A, and FIG. 3B, the limiting unit 140 includes a cover 142 and a plurality of screws 144. The cover 142 is configured at the ends of the pillars 134 away from the surface 132. The screws 144 pass through the cover 142 and are correspondingly locked into the pillars 134. The cover 142 is made of plastic. Besides, the cover 142 restricts the second adapter 120 to move between the cover 142 and the adapter ring 132 along the pillars 134. The cover 142 can also be made of metal, which is determined based on actual requirements.

In another embodiment which is not shown in the drawings, the limiting unit 140 can also refer to a plurality of screws, and a diameter of a head of each of the screws is greater than an outer diameter of each of the pillars 134. Thereby, the second adapter 120 is also unlikely to be disassembled from the pillars 134.

Figure 3C:
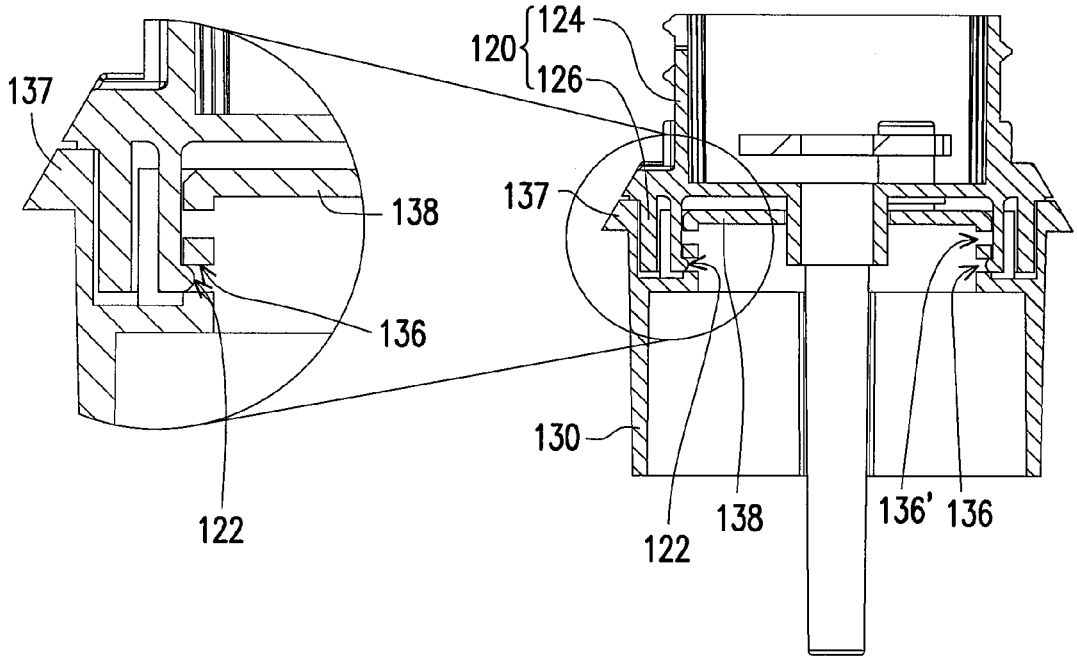
FIG. 3C is a schematic cross-sectional view taken along a sectional line B-B depicted in FIG. 3A.

FIG. 3C is a schematic cross-sectional view taken along a sectional line B-B depicted in FIG. 3A. As indicated in FIG. 3A and FIG. 3C, in order to position the second adapter 120 relative to the pillars 134, the second adapter 120 can have a plurality of first positioning structures 122, and the adapter ring 130 has two pairs of second positioning structures 136 and 136'. The two pairs of second positioning structures 136 and 136' are arranged along an axial direction of the pillars 134 (shown in FIG. 3B). The first positioning structures 122 can be correspondingly buckled with one set of the second positioning structures 136 and 136'. The first positioning structures 122 are protrusions, and the second positioning structures 136 are grooves in this embodiment, which should be construed as an example of the invention. People having ordinary skill in the art can modify the types or the shapes of the first and second positioning structures 122 and 136 as long as the first and second positioning structures 122 and 136 can be correspondingly buckled to position the second adapter 120 relative to the pillars 134.

As shown in FIG. 1 and FIG. 3C, to be more specific, the adapter ring 130 of this embodiment has a first portion 137 and a second portion 138. The second portion 138 has a substantially circular shape, and the first portion 137 surrounds the second portion 138. The surface 132 and the pillars 134 are located at the second portion 138. The second adapter 120 has a third portion 124 and a fourth portion 126. The third portion 124 is lodged in the first adapter 110, and the fourth portion 126 is lodged in the second portion 138 of the adapter ring 130. The first positioning structures 122 are configured at the third portion 124, and the second positioning structures 136 are configured at a side wall of the second portion 138. In another embodiment which is not shown in the drawings, the second positioning structures 136 can also be configured at the pillars 134. The second adapter 120 can have a fifth portion 128 (shown in FIG. 3B) that is connected between the third portion 124 and the fourth portion 126. The first positioning structures 122 can be configured at one side of the fifth portion 128 in contact with the pillars 134.

Figure 3D:
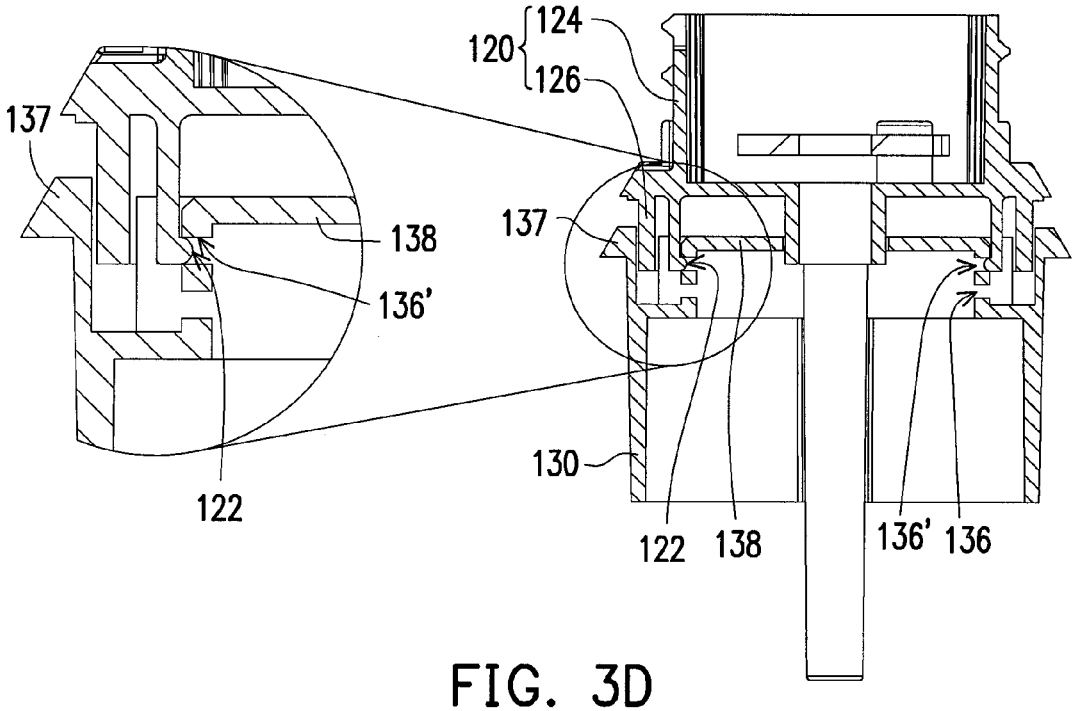
FIG. 3D is a schematic cross-sectional view illustrating a portion of the adjustable lamp structure after the lamp structure is lengthened.

With reference to FIG. 1, FIG. 2A, and FIG. 3C, when the first and second positioning structures 122 and 136 are correspondingly buckled, the length of the adjustable lamp structure 100 is not extended. FIG. 3D is a schematic cross-sectional view illustrating a portion of the adjustable lamp structure after the lamp structure is lengthened. As indicated in FIG. 1, FIG. 2B, and FIG. 3D, the first adapter 110 can be manually pulled, such that the second adapter 120 engaged with the first adapter 110 moves along the axial direction of the pillars 134. The first positioning structures 122 are disassembled from the second positioning structures 136 and moved to the second positioning structures 136', and the first and second positioning structures 122 and 136' are correspondingly buckled. Here, the entire length of the adjustable lamp structure 100 is increased.

To sum up, in the adjustable lamp structure described in the embodiments of the invention, the pillars of the adapter ring allow the second adapter that passes through the pillars to move on the pillars. Thereby, the relative positions of the second adapter and the pillars can be changed, and the entire length of the lamp structure can be adjusted based on actual requirements, so as to meet the requirements for customization. In addition, the limiting unit can prevent the second adapter from being disassembled from the adapter ring. Moreover, the positioning structures can fix the second adapter onto a certain part of the pillars, such that the second adapter does not unexpectedly slide relative to the adapter ring.

Although the invention has been described with reference to the above embodiments, it will be apparent to one of the ordinary skill in the art that modifications to the described embodiments may be made without departing from the spirit of the invention. Accordingly, the scope of the invention will be defined by the attached claims rather than by the above detailed descriptions.

What is claimed is:

1. An adjustable lamp structure suitable for being configured on a lamp base, the adjustable lamp structure comprising:

a first adapter suitable for being configured on the lamp base;

a second adapter configured in the first adapter;

an adapter ring configured at one side of the second adapter away from the first adapter, the adapter ring having a surface and a plurality of pillars, the surface facing the second adapter, the pillars being configured on the surface, the second adapter being engaged with the pillars;

at least one limiting unit located in the second adapter and fixed at ends of the pillars away from the surface, so as to limit a moving distance of the second adapter on the pillars;

a heat sink engaged with the adapter ring and located at one side of the adapter ring away from the second adapter; and a lampshade configured at one side of the heat sink away from the first adapter, wherein an entire length of the lamp structure is changeable by adjusting relative positions of the second adapter and the pillars.

2. The adjustable lamp structure as claimed in claim 1, wherein the first adapter has an external thread.

3. The adjustable lamp structure as claimed in claim 1, wherein a material of the adapter ring is metal, and the pillars are protrusions extending from the surface.

4. The adjustable lamp structure as claimed in claim 1, wherein the at least one limiting unit refers to a plurality of screws, and a diameter of a head of each of the screws is greater than an outer diameter of each of the pillars.

5. The adjustable lamp structure as claimed in claim 1, wherein the at least one limiting unit comprises:

a cover configured at the ends of the pillars away from the surface; and a plurality of screws passing through the cover, the screws being correspondingly locked to the pillars.

6. The adjustable lamp structure as claimed in claim 1, wherein the second adapter has a plurality of first positioning structures, the adapter ring has a plurality of second positioning structures, and the first positioning structures and the second positioning structures are correspondingly buckled, so as to position the second adapter relative to the pillars.

7. The adjustable lamp structure as claimed in claim 6, wherein the first positioning structures are grooves when the second positioning structures are protrusions, or the first positioning structures are protrusions when the second positioning structures are grooves.

8. The adjustable lamp structure as claimed in claim 6, wherein the adapter ring has a first portion and a second portion, the first portion surrounds the second portion, and the surface and the pillars are located on the second portion.

9. The adjustable lamp structure as claimed in claim 8, wherein the second adapter has a third portion and a fourth portion, the third portion is lodged in the first adapter, and the fourth portion is lodged in the second portion of the adapter ring.

10. The adjustable lamp structure as claimed in claim 9, wherein the first positioning structures are configured at the third portion, and the second positioning structures are configured at one side wall of the second portion.

11. The adjustable lamp structure as claimed in claim 9, wherein the second positioning structures are configured at the pillars, the second adapter further has a fifth portion connected between the third portion and the fourth portion, and the first positioning structures are configured at a side surface of the fifth portion in contact with the pillars.

* * * * *